US006062325A

United States Patent [19]

Taylor et al.

[11] Patent Number: 6,062,325

[45] Date of Patent: May 16, 2000

[54] ROTARY DRILL BITS

[75] Inventors: Malcolm Roy Taylor, Gloucester; Steven Taylor; Dean Travers Watson, both of Cheltenham, all of United Kingdom

[73] Assignee: Camco International (UK) Limited, Gloucestershire, United Kingdom

[21] Appl. No.: 09/061,679

[22] Filed: Apr. 16, 1998

[30] Foreign Application Priority Data

Apr. 21, 1997 [GB] United Kingdom ..... 9708022

[51] Int. Cl.[7] ..... E21B 10/60

[52] U.S. Cl. ..... 175/393; 175/378; 175/400

[58] Field of Search ..... 175/376, 378, 175/398, 400, 393, 394

[56] References Cited

U.S. PATENT DOCUMENTS

| | | | |
|---|---|---|---|
| 3,951,220 | 4/1976 | Phillips, Jr. et al. . | |
| 4,350,215 | 9/1982 | Badtke | 175/329 |
| 4,351,401 | 9/1982 | Fielder . | |
| 4,373,593 | 2/1983 | Phaal et al. . | |
| 4,776,411 | 10/1988 | Jones | 175/393 |
| 4,794,994 | 1/1989 | Deane et al. | 175/329 |
| 4,848,491 | 7/1989 | Burridge et al. . | |
| 5,443,565 | 8/1995 | Strange, Jr. . | |
| 5,904,212 | 5/1999 | Arfele | 175/374 |

FOREIGN PATENT DOCUMENTS

| | | |
|---|---|---|
| 2197676 | 5/1988 | United Kingdom . |
| 2277760 | 11/1994 | United Kingdom . |
| 2294070 | 4/1996 | United Kingdom . |

*Primary Examiner*—Frank Tsay
*Attorney, Agent, or Firm*—Jeffery E. Daly

[57] ABSTRACT

A rotary drag-type drill bit, for drilling holes in subsurface formations, comprises a bit body having a leading face and a gauge region, a number of blades formed on the leading face of the bit and extending outwardly away from the axis of the bit so as to define between the blades fluid channels leading towards junk slots in the gauge region. Cutting elements are mounted along each blade, and nozzles in the bit body supply drilling fluid to the leading face of the bit for cleaning and cooling the cutting elements. At least some of said blades each have a leading edge which is non-linear, or convexly or concavely curved, as viewed axially of the bit, as it extends outwardly away from the axis of the bit. Blades of different shapes may be located alternately around the axis of the bit. The junk slots at the gauge region, and the kickers between which they are formed, may vary in width around the periphery of the bit, and may be inclined to the axis of the bit.

19 Claims, 3 Drawing Sheets

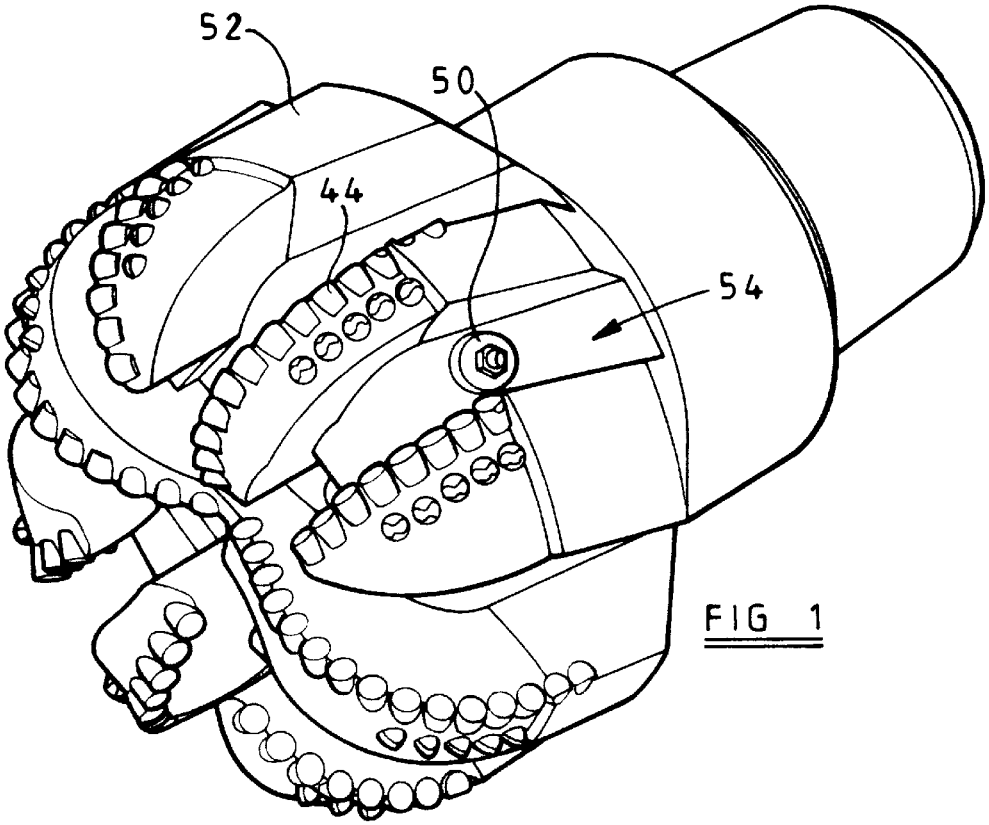
FIG 1
FIG 2
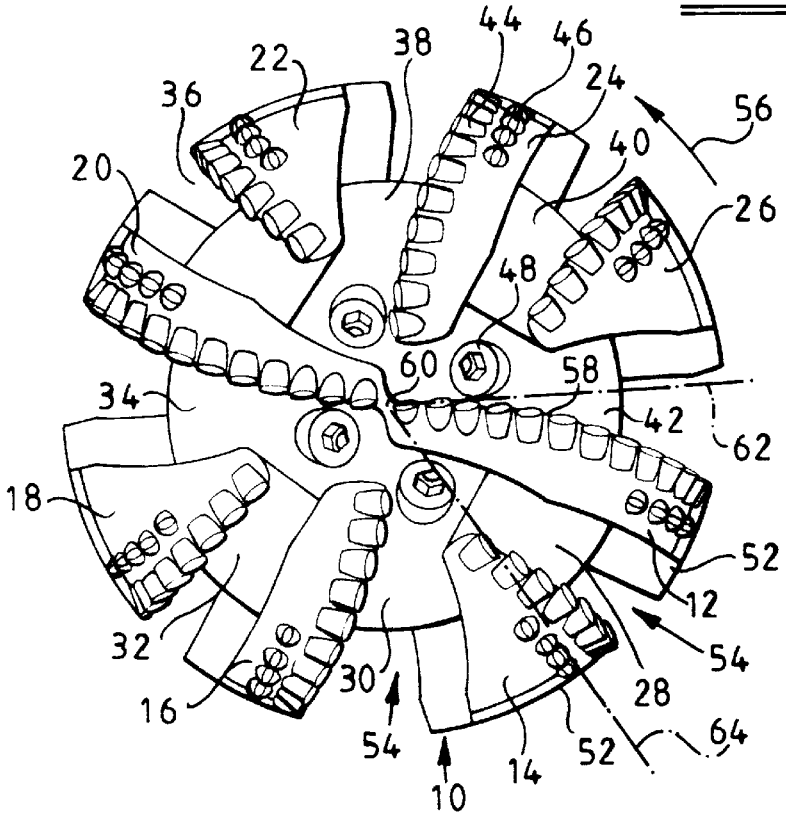

ROTARY DRILL BITS

BACKGROUND OF THE INVENTION

1. Field of Invention

The invention relates to rotary drill bits for use in drilling holes in subsurface formations, and of the kind comprising a bit body having a leading face and a gauge region, a plurality of blades formed on the leading face of the bit and extending outwardly away from the axis of the bit towards the gauge region so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements.

2. Description of Related Art

The invention is particularly, but not exclusively, applicable to drill bits in which some or all of the cutters are preform (PDC) cutters each formed, at least in part, from polycrystalline diamond. One common form of cutter comprises a tablet, usually circular or part-circular, made up of a superhard table of polycrystalline diamond, providing the front cutting face of the element, bonded to a substrate which is usually of cemented tungsten carbide.

The bit body may be machined from solid metal, usually steel, or may be moulded using a powder metallurgy process in which tungsten carbide powder is infiltrated with a metal alloy binder in a furnace so as to form a hard matrix.

Hitherto in drill bits of this kind it has been usual for the leading edge of each blade, along which the cutting elements are mounted, to be substantially straight so that the cutting elements also extend in a substantially straight line, as viewed axially of the drill bit, as they extend outwardly away from the central axis of the bit. Often the leading edges of the blades extend generally radially, although arrangements are known in which the leading edges of the blades are inclined forwardly or rearwardly of the radius which passes through the inner end of the leading edge.

The present invention sets out to provide a novel arrangement whereby the leading edges of at least some of the blades on the drill bit are curved, which may provide certain advantages as will be explained hereinafter.

SUMMARY OF THE INVENTION

According to the invention there is provided a rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is non-linear, as viewed axially of the bit, as it extends outwardly away from the axis of the bit.

In the present specification, the term "non-linear" is intended to include any configuration which is not straight, or convexly curved, or concavely curved, over the whole of its length. The term "non-linear" therefore includes configurations where the leading edge has two or more successive portions, along its length, which are straight or convexly curved or concavely curved in any combination, as well as other shapes.

The leading edge of each of said blades may have a portion which is convexly or concavely curved in the normal direction of rotation of the bit during drilling. The leading edge of each of said blades may have at least one convexly curved portion and at least one concavely curved portion, for example the leading edge may be substantially S-shaped. The leading edge of each of said blades may have a portion which is substantially straight.

The drill bit includes, in addition to said non-linear blades, blades which are substantially straight as viewed axially of the bit, and/or which are substantially smoothly and continuously curved as viewed axially of the bit. Said additional smoothly and continuously curved blades may be convex or concave in the normal direction of rotation of the bit during drilling.

The invention also provides a rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is curved, as viewed axially of the bit, as it extends outwardly away from the axis of the bit, and is concave in the normal direction of rotation of the bit during drilling.

The leading edge of at least one of said blades may have an inner end and may extend forwardly or rearwardly with respect to a radius which passes through the inner end of the leading edge.

The drill bit may include, in addition to said concave blades, blades which are substantially straight or convexly curved as viewed axially of the bit.

The invention further provides a rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is which is convexly curved in the normal direction of rotation of the bit during drilling, and others of said blades each having a leading edge at least a portion of which is concavely curved in the normal direction of rotation of the bit during drilling.

The convex blades may alternate with the concave blades around the axis of the bit The invention further provides a rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, each blade leading to a kicker which extends across the gauge region of the drill bit, there being defined between the kickers junk slots which form respective continuations of the fluid channels between the blades, at least some of the junk slots and kickers being inclined with respect to the axis of the drill bit.

The junk slots and kickers may be inclined rearwardly or forwardly, with respect to the normal direction of rotation of the drill bit, as they extend away from the leading face of the bit.

The circumferential width of the junk slots and/or the kickers may vary around the periphery of the gauge.

Such arrangement provides that the gauge region of the drill bit is not symmetrical and it is believed that such an arrangement may enhance the ability of the drill bit to resist vibration. Vibration can be damaging to a PDC bit, particularly in harder formations, where the recurring momentary impact loads caused by vibration can lead to damage to the cutting elements. One of the most harmful types of vibration can be attributed to a phenomenon called "bit whirl" where the drill bit, in the course of drilling, begins to precess around the borehole in the opposite direction to rotation of the drill bit. This can lead to momentary reversal of the direction of movement of cutters, resulting in significant damage to the cutters. It is believed that an asymmetric and irregular configuration of the gauge region of the drill bit, which engages the walls of the borehole, may inhibit the initiation and development of bit whirl.

It may be desirable in some cases that the inner ends of the leading edges of the blades should be generally equally spaced about the inner region of the leading face of the bit body, for example so as to provide adequate space for the cutters and nozzles which require to be mounted in this inner region. In prior art PDC drill bits, such symmetrical arrangement of the inner ends of the blades has necessarily resulted in a corresponding symmetrical arrangement of the outer ends of the blades, with corresponding substantially symmetrical arrangement of the junk slots and kickers. By curving the leading edges of the blades according to the present invention, however, the circumferential spacing of the outer ends of the blades does not necessarily have to correspond to the spacing of the inner ends of the blades, with the result that the regular spacing in the inner region of the leading face of the bit body may be accompanied by irregular and asymmetric spacing at the gauge.

According to another aspect of the present invention, therefore, there is provided a rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling of the cutting elements, the gauge region including a plurality of kickers spaced apart around the gauge, and junk slots defined between the kickers, the circumferential width of the junk slots and/or the kickers being varied around the circumference of the gauge.

The invention further provides a rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, wherein the inner ends of the blades are substantially equally spaced around an inner region of the leading face of the bit body and the outer ends of the blades are irregularly spaced apart at the outer periphery of the leading face of the bit.

BRIEF DESCRIPTION OF THE DRAWINGS

FIG. 1 is a perspective view of a PDC drill bit in accordance with the present invention.

FIG. 2 is an view of the drill bit shown in FIG. 1.

DETAILED DESCRIPTION OF THE PREFERRED EMBODIMENTS

Figure 3:
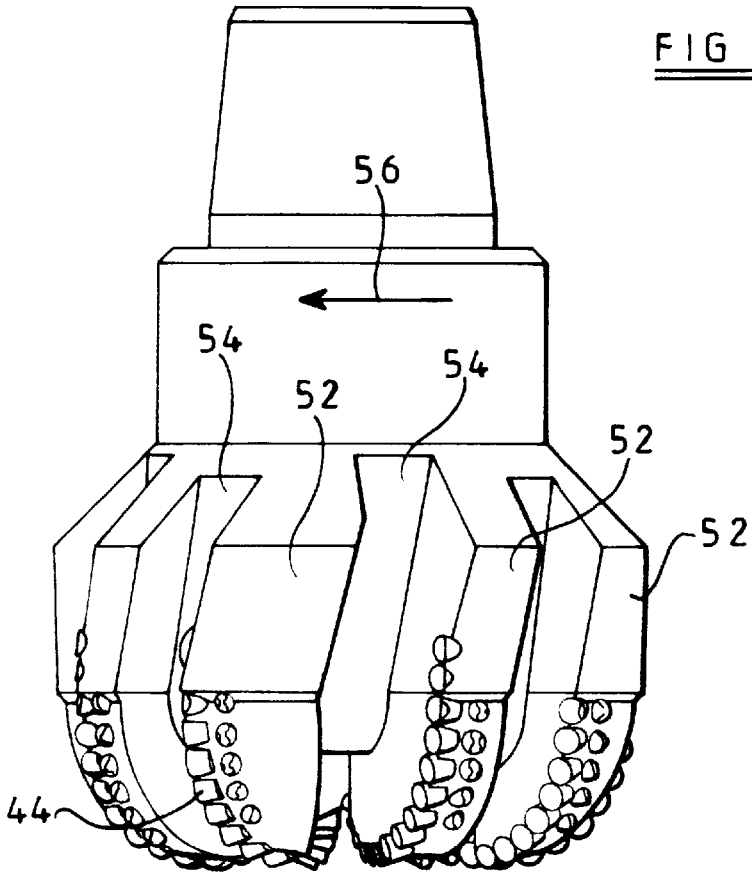
FIG. 3 is a side elevation of the drill bit.

Referring to FIGS. 1–3, the drill bit comprises a bit body 10 and eight blades 12, 14, 16, 18, 22, 24, 26 formed on the leading face of the bit and extending outwardly from the axis of the bit body towards the gauge region. Between adjacent blades there are defined channels 28, 30, 32, 34, 36,38,40, 42.

Extending side-by-side along each of the blades is a plurality of cutting structures, indicated at 44. The precise nature of the cutting structures does not form a part of the present invention and they may be of any appropriate type. For example, as shown, they may comprise circular pre-formed cutting elements brazed to cylindrical carriers which are embedded or otherwise mounted in the blades, the cutting elements each comprising a pre-formed compact having a polycrystalline diamond front cutting table bonded to a tungsten carbide substrate, the compact being brazed to a cylindrical tungsten carbide carrier. Alternatively, the substrate of the pre-formed compact may itself be of sufficient length to be mounted directly in the blade, the additional carrier then being omitted.

Back-up abrasion elements or cutters 46 may be spaced rearwardly of the outermost cutters 44, as shown.

Inner nozzles 48 are mounted in the surface of the bit body and are located fairly close to the central axis of the rotation of the bit. Each inner nozzle 48 is so located that it can deliver drilling fluid to two or more channels but is so orientated that it primarily delivers drilling fluid outwardly along a channel on the leading side of one of the four longer blades 12, 16, 20 or 24.

In addition, outer nozzles 50 (see FIG. 1) are located in the channels 28, 32, 36 and 40, at the outer extremity of each channel, and are orientated to direct drilling fluid inwardly along their respective channels towards the centre of the drill bit, such inwardly flowing drilling fluid becoming entrained with the drilling fluid from the associated inner nozzle 48 so as to flow outwardly to the gauge region again along the adjacent channel. All the nozzles communicate with a central axial passage (not shown) in the shank of the bit, to which drilling fluid is supplied under pressure downwardly through the drill string in known manner.

The outer extremities of the blades are formed with kickers 52 which provide part-cylindrical bearing surfaces which, in use, bear against the surrounding wall of the borehole and stabilise the bit in the borehole. Abrasion-resistant bearing elements (not shown), of any suitable known form, are embedded in the bearing surfaces.

Each of the channels between the blades leads to a respective junk slot 54. The junk slots extend upwardly between the kickers 52, so that drilling fluid flowing outwardly along each channel passes into the associated junk slot and flows upwardly, between the bit body and the surrounding formation, into the annulus between the drill string and the wall of the borehole.

As best seen in FIG. 3, the kickers 52 and junk slots 54 do not extend axially of the drill bit but are inclined rearwardly with respect to the normal direction of rotation of the drill bit (indicated by the arrow 56) as they extend upwardly away from the leading face of the drill bit.

As best seen in FIG. 2, each of the blades 12–26 on the leading face of the drill bit has a leading edge 58 which is curved as it extends outwardly away from the central axis 60 of the drill bit. The cutting elements 44, since they are mounted side-by-side along the leading edge of each blade, are also disposed along a curved line corresponding to the curvature of the leading edge of the blade.

Each blade has a curvature which is convex in the normal direction of rotation of the bit during drilling, as indicated by the arrow 56.

In the case of the four longer blades 12, 16, 20 and 24 the leading edge 58 of each blade extends rearwardly with respect to the radius which passes through the inner end of the leading edge of the blade, as indicated, for example by the radius 62 in FIG. 2. On the other hand, each of the shorter blades 14, 18, 22 and 26 extends forwardly with respect to the radius which passes through its inner end, as indicated by the radius 64.

As best seen in FIG. 2, the inner ends of the eight blades are spaced substantially equally apart around the innermost region of the leading face of the drill bit, thus providing adequate space for the location of the inner cutters and nozzles 48 in this region.

However, as a result of the curvature of the leading edges of the blades and the relative disposition of the blades outwardly of the inner region, the outer extremities of the blades are not spaced generally equally apart around the outer periphery of the drill bit. This has the result, as may be seen in FIGS. 1–3, that the bearing surfaces of the kickers 52 are of varying circumferential width, and the junk slots 54 between them are also of varying circumferential width thereby varying the spacing between adjacent kickers 52. The arrangement of the bearing surfaces of the kickers is therefore non-symmetrical around the gauge region and, as previously explained, such arrangement can prevent or inhibit the initiation and/or sustaining of vibration, and particularly bit whirl, thereby substantially enhancing the stability of the drill bit.

Figure 4:
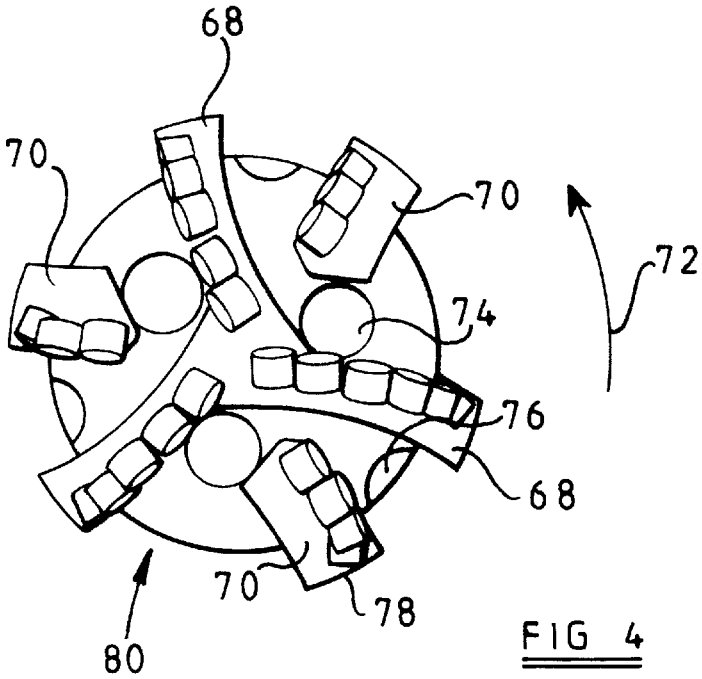
FIG. 4 is an end view of another form of drill bit in accordance with the invention.

In the alternative arrangement shown in FIG. 4, the leading face of the bit body 66 is formed with six blades, comprising three longer blades 68 alternating with three shorter blades 70. In this arrangement both the longer blades 68 and the shorter blades 70 have leading edges which are curved convexly in the direction of normal rotation of the drill bit as indicated by the arrow 72. As in the previously described arrangement, each blade 68 or 70 extends rearwardly of the radius which extends through the inner end of the leading edge of the blade.

Nozzles 74 are provided in the inner region of the leading face of the bit body and are supplemented by inwardly directed peripheral nozzles 76 which direct drilling fluid inwardly towards the axis of the drill bit along the channels on the rearward side of the three longer blades 68.

As in the previously described arrangement the kickers 78 and junk slots 80 in the gauge region of the drill bit are inclined rearwardly as they extend away from the leading face of the drill bit to the annulus. Also, as in the previous arrangement, the kickers 78 and junk slots 80 differ in circumferential width and spacing around the gauge region with the advantages previously referred to.

Figure 5:
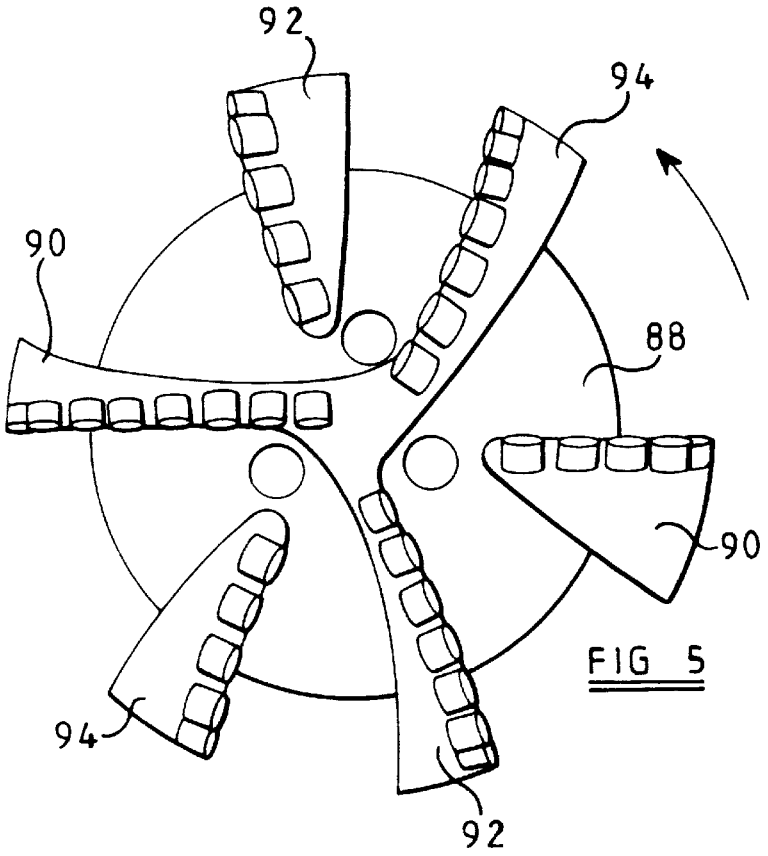
FIGS. 5 and 6 are diagrammatic end views of further forms of drill bit in accordance with the present invention.

FIG. 5 shows diagrammatically a further modification where the bit body 88 is formed with six blades. These comprise two substantially straight radial blades 90, two convexly curved blades 92 and two concavely curved blades 94 alternately arranged around the leading face of the drill bit. As may be seen from FIG. 5 the longitudinal shapes of the blades allows the inner ends of the blades to be spaced substantially equally apart around the inner region of the leading face of the drill bit (i.e. being angularly spaced by about 60° between each blade), whereas the angular spacing between the outer ends of the blades, and hence the associated junk slots and kickers, is asymmetrical as a result of the curvatures of the blades 92 and 94.

Figure 6:
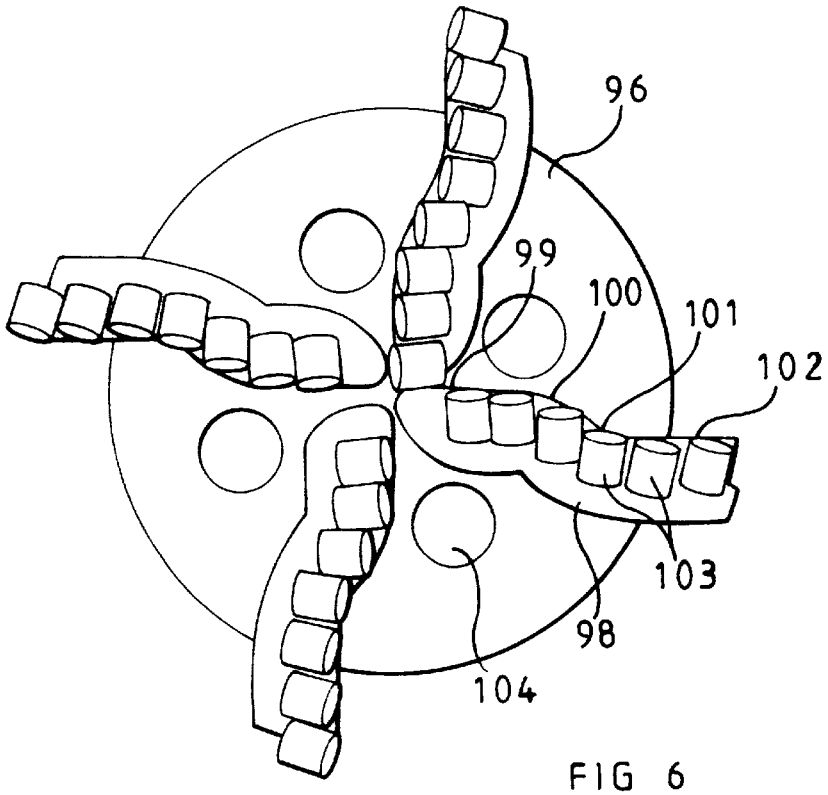

FIG. 6 is an end view of a further form of drill bit in accordance with the invention. In this case the leading face 96 of the bit body is formed with four similar blades 98 spaced equally apart around the leading face. In this case the leading edge of each blade 98 is non-linear in that it comprises an inner straight portion 99 adjacent convex and concave portions 100 and 101 respectively, and an outer straight portion 102. The leading edge of each blade is therefore generally S-shaped.

Cutting structures 103 are mounted in sockets along the leading edge of each blade, in any conventional manner, and the front cutting faces of the cutting structures 103 follow the non-linear contour of the leading edge of each blade.

Nozzles 104 are provided in the inner region of the leading face of the bit body to direct drilling fluid outwardly in front of the blades.

Other non-linear arrangements of the leading edges of the blades are possible and the shape of the leading edge may comprise any combination of straight, convexly curved and concavely curved portions. It is not necessary for the leading edges of all the blades to be of similar shape and the drill bit may have some blades which are non-linear and other blades which are substantially straight or convexly or concavely curved, as viewed axially of the bit.

Whereas the present invention has been described in particular relation to the drawings attached hereto, it should be understood that other and further modifications, apart from those shown or suggested herein, may be made within the scope and spirit of the present invention.

What is claimed is:

1. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is which is convexly curved in the normal direction of rotation of the bit during drilling, and others of said blades each having a leading edge at least a portion of which is concavely curved in the normal direction of rotation of the bit during drilling.

2. A rotary drill bit according to claim 1, wherein the convex blades alternate with the concave blades around the axis of the bit.

3. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, each blade leading to a kicker which extends across the gauge region of the drill bit, there being defined between the kickers junk slots which form respective continuations of the fluid channels between the blades, at least some of the junk slots and kickers being inclined with respect to the axis of the drill bit.

4. A rotary drill bit according to claim 3, wherein the junk slots and kickers are inclined rearwardly, with respect to the normal direction of rotation of the drill bit, as they extend away from the leading face of the bit.

5. A rotary drill bit according to claim 3, wherein the junk slots and kickers are inclined forwardly, with respect to the normal direction of rotation of the drill bit, as they extend away from the leading face of the bit.

6. A rotary drill bit according to claim 3, wherein the circumferential width of the junk slots varies around the periphery of the gauge.

7. A rotary drill bit according to claim 3, wherein the circumferential width of the kickers varies around the periphery of the gauge.

8. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling of the cutting elements, the gauge region including a plurality of kickers spaced apart around the gauge, and junk slots defined between the kickers, the circumferential width of the junk slots and/or the kickers being varied around the circumference of the gauge.

9. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, wherein the inner ends of the blades are substantially equally spaced around an inner region of the leading face of the bit body and the outer ends of the blades are irregularly spaced apart at the outer periphery of the leading face of the bit.

10. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is non-linear, as viewed axially of the bit, as it extends outwardly away from the axis of the bit, wherein the leading edge of each of said blades have at least one convexly curved portion and at least one concavely curved portion, and the leading edge of each of said blades is substantially S-shaped.

11. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is non-linear, as viewed axially of the bit, as it extends outwardly away from the axis of the bit wherein the leading edge of each of said blades has a portion which is substantially straight.

12. A rotary drill bit according to claim 11 wherein the leading edge of each of said blades has a portion which is convexly curved in the normal direction of rotation of the bit during drilling.

13. A rotary drill bit according to claim 11, wherein the leading edge of each of said blades has a portion which is concavely curved in the normal direction of rotation of the bit during drilling.

14. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is non-linear, as viewed axially of the bit, as it extends outwardly away from the axis of the bit wherein the drill bit includes, in addition to said non-linear blades, blades which are substantially straight as viewed axially of the bit.

15. A rotary drill bit according to claim 14, wherein the drill bit includes, in addition to said non-linear blades, blades which are substantially smoothly and continuously curved as viewed axially of the bit.

16. A rotary drill bit according to claim 14, wherein at least some of said smoothly and continuously curved blades are convex in the normal direction of rotation of the bit during drilling.

17. A rotary drill bit for use in drilling holes in subsurface formations, comprising a bit body having a leading face and a gauge region, a plurality of blades formed on the leading face of the bit and extending outwardly away from the axis of the bit so as to define between the blades a plurality of fluid channels leading towards the gauge region, a plurality of cutting elements mounted along each blade, and a plurality of nozzles in the bit body for supplying drilling fluid to the leading face of the bit for cleaning and cooling the cutting elements, at least some of said blades each having a leading edge at least a portion of which is curved, as viewed axially of the bit, as it extends outwardly away from the axis of the bit, and is concave in the normal direction of rotation of the bit during drilling wherein the leading edge of at least one of said blades has an inner end and extends rearwardly with respect to a radius which passes through the inner end of the leading edge.

18. A rotary drill bit according to claim 17, wherein the drill bit includes, in addition to said concave blades, blades which are substantially straight as viewed axially of the bit.

19. A rotary drill bit according to claim 17, wherein the drill bit includes, in addition to said concave blades, blades which are convex in the normal direction of rotation of the bit during drilling.

* * * * *